US011396398B2

(12) United States Patent
Gressel et al.

(10) Patent No.: US 11,396,398 B2
(45) **Date of Patent: *Jul. 26, 2022**

(54) SHIPPING AND DISPLAY CONTAINER AND METHOD OF MAKING THE SAME

(71) Applicant: THE HERSHEY COMPANY, Hershey, PA (US)

(72) Inventors: Gregory M. Gressel, Hershey, PA (US); Jonathan M. Genord, Elizabethtown, PA (US); Michael W. Long, Annville, PA (US); Katelyn R. Rocheleau, West Bloomfield, MI (US)

(73) Assignee: The Hershey Company, Hershey, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/223,001

(22) Filed: Apr. 6, 2021

(65) Prior Publication Data

US 2021/0331827 A1 Oct. 28, 2021

Related U.S. Application Data

(62) Division of application No. 16/067,979, filed on Jul. 3, 2018, now Pat. No. 11,072,457.

(51) Int. Cl.

| | |
|---|---|
| ***B65D 5/54*** | (2006.01) |
| ***B65D 5/02*** | (2006.01) |
| ***B65D 5/16*** | (2006.01) |
| ***B65D 5/44*** | (2006.01) |
| ***B65D 5/36*** | (2006.01) |
| ***B65D 5/00*** | (2006.01) |
| ***B31B 50/26*** | (2017.01) |

(52) U.S. Cl.

CPC ..... *B65D 5/5405* (2013.01); *B31B 50/26* (2017.08); *B65D 5/001* (2013.01); *B65D 5/0227* (2013.01); *B65D 5/0281* (2013.01); *B65D 5/16* (2013.01); *B65D 5/3621* (2013.01); *B65D 5/445* (2013.01)

(58) Field of Classification Search

CPC .... B65D 5/5405; B65D 5/0227; B65D 5/445; B65D 5/001; B65D 5/16; B65D 5/0281; B65D 5/3621; B65D 5/5213; B65D 5/4204

USPC ..... 229/122.32, 166, 185.1, 103, 919, 240; 206/750, 774; 221/305; 312/259

See application file for complete search history.

(56) References Cited

U.S. PATENT DOCUMENTS

| | | | | |
|---|---|---|---|---|
| 2,349,241 A * | 5/1944 | Arneson | ..... | B65D 5/0281 229/167 |
| 4,804,138 A * | 2/1989 | McFarland | ..... | B65D 5/4208 229/117.12 |
| 5,413,276 A * | 5/1995 | Sheffer | ..... | B65D 5/16 229/120.03 |

(Continued)

*Primary Examiner* — Christopher R Demeree

(74) *Attorney, Agent, or Firm* — Jordan IP Law, LLC

(57) ABSTRACT

The present disclosure relates, in general, to stackable containers which are effective for shipping goods to a point of sale and for being easily and reliably converted into a merchandise display case after delivery. More particularly, provided herein is a foldable, stackable shipping and display container for shipping goods to a point of sale can be easily converted into a merchandise display case, and can be formed from one or more blanks folded and formed according to a method for creating the box such that it encloses the storage space on all sides.

24 Claims, 13 Drawing Sheets

(56) References Cited

U.S. PATENT DOCUMENTS

| | | | | |
|---|---|---|---|---|
| 6,015,084 | A * | 1/2000 | Mathieu | B65D 5/566 229/122.32 |
| 6,948,617 | B2 * | 9/2005 | Kanter | B65D 5/001 206/504 |
| 7,703,864 | B2 * | 4/2010 | Moser | B65D 5/5213 312/261 |
| 8,177,117 | B2 * | 5/2012 | Little | B65D 5/16 229/120.18 |
| 8,297,490 | B2 * | 10/2012 | Little | B65D 5/445 229/122.32 |
| 8,763,888 | B2 * | 7/2014 | Willman | B65D 5/10 229/117 |
| 10,470,591 | B1 * | 11/2019 | Heiden | B31D 5/04 |
| 2004/0060974 | A1 * | 4/2004 | Dacey | B65D 5/543 229/225 |
| 2012/0193406 | A1 * | 8/2012 | Putt | B65D 5/0227 229/242 |
| 2013/0082096 | A1 * | 4/2013 | Laughman | B65D 5/541 229/120.02 |
| 2014/0001249 | A1 * | 1/2014 | Little | B65D 5/16 229/120.17 |
| 2019/0009946 | A1 * | 1/2019 | Nixon | B65D 5/542 |
| 2020/0024028 | A1 * | 1/2020 | Holdsworth | B65D 5/26 |

* cited by examiner

SHIPPING AND DISPLAY CONTAINER AND METHOD OF MAKING THE SAME

PRIORITY CLAIM

This divisional patent application claims priority to U.S. patent application Ser. No. 16/067,979 filed on Jul. 3, 2018.

FIELD OF THE INVENTION

The present disclosure relates, in general, to stackable containers which are effective for shipping goods to a point of sale and for being easily and reliably converted into a merchandise display case after delivery.

BACKGROUND

Containers made of corrugated fiberboard are in widespread use for shipping and selling goods. Flat sheets of corrugated fiberboard, referred to as blanks, are typically used as starting material to form corrugated containers such as boxes. One or more blanks may be cut to a desired shape, having a plurality of sections that will form side panels, end panels, top flaps, bottom sections, and other components of a box. The panels are generally defined by scored, perforated, slotted or cut lines in locations which form joints where the blank is folded into an assembled box. Some sections of a blank may be attached to other sections by adhering means, for example, glue or double-sided tape.

There is an increasing demand for multipurpose shipping containers that can be quickly and efficiently converted into display cases. Such containers minimize the amount of container material while maximizing the display space available. They also minimize the amount of time and labor a retail establishment must provide to display goods for sale.

In order to be economically viable, the containers must be capable of being shipped in flattened form to the location where the goods will be packaged, then assembled, or erected, into box form. The flattened forms are known in the industry as knocked down flats (KDFs) or pre-assemblies, because the flattened forms have panels which are glued or otherwise joined together, such that the box is in a pre-assembled state. Assembling or erecting the boxes requires that panels be squared up, flaps folded, and typically tape applied one or more flaps to maintain the box in an assembled state. It is desirable to use as little corrugated material as needed to deliver a box with the required strength that is easily assembled into box form.

A blank or blanks constructed from a material which may be easily cut, scored and folded, such as corrugated fiberboard, may be configured into pre-assembled boxes (KDFs). These flattened forms may have members or panels which have been affixed to one another but not finally erected or assembled into a box. Thus, the KDFs may be shipped more 35 efficiently in flattened form and subsequently erected or assembled into boxes when a shipping container is required. The filled boxes may then be shipped to a point of sale where they are converted into a display case by removing a window panel which has been designed to tear away from the box.

Once the boxes are formed and filled, they are typically sealed by sequentially folding and overlapping the top and bottom panels and securing them with adhering means, for example, tape. Standard shipping practices call for filled boxes to be stacked into pallet loads requiring the boxes to be strong enough to be stacked in multiple layers when filled with goods.

Constructing containers that are constructed to be in a knock-down flat configuration when not filled with product typically requires a relatively complex blank and a relatively 10 complex assembly process—typically requiring manual labor, which results in relatively high manufacturing costs.

Upon delivery to a retail establishment, it is desirable that the boxes be easily and reliably converted into attractive display cases, preferably without the need for cutting tools which create a workplace safety hazard and risk of damage to the goods. A removable (or tear away) window is one means of providing such conversion. In prior container designs, however, tear away windows frequently do not open quickly or easily to form display cases, or they may do so in a way that rips the corrugated material or leaves jagged openings which create unattractive displays. In addition, many removable windows of prior designs are also susceptible to being prematurely separated from the box.

It is also desirable for such boxes to be stacked when on display, in order to optimize floor or shelf space. Many prior art containers do not have sufficient strength to support the weight of goods and containers. This either limits the height of displays and/or results in a damaged or unattractive display.

Prior designs for multipurpose shipping boxes which convert into display cases suffer from a number of other disadvantages. They may be labor intensive or expensive to manufacture and assemble. They may require excessive materials or elaborate construction to meet the need for strength and the ability to open into a display case. Some designs may require retail employees to use cutting tools to open the boxes, creating the risk of workplace injury or damage to products inside the boxes.

Therefore, there is an unmet need for a multipurpose shipping container that is economical to build, uses as little material as possible, is easy to assemble, and is strong, stackable, and efficiently and reliably converts into an attractive retail display case. There is also a need to provide a method of manufacturing such multipurpose shipping containers and their associated pre-assembled knock down flat formations.

BRIEF DESCRIPTION OF THE DRAWINGS

Configurations for a shipping, storage and display box, blanks for forming the box, and related methods according to the present invention are further described with reference to the accompanying drawings.

SUMMARY OF THE INVENTION

Figure 1:
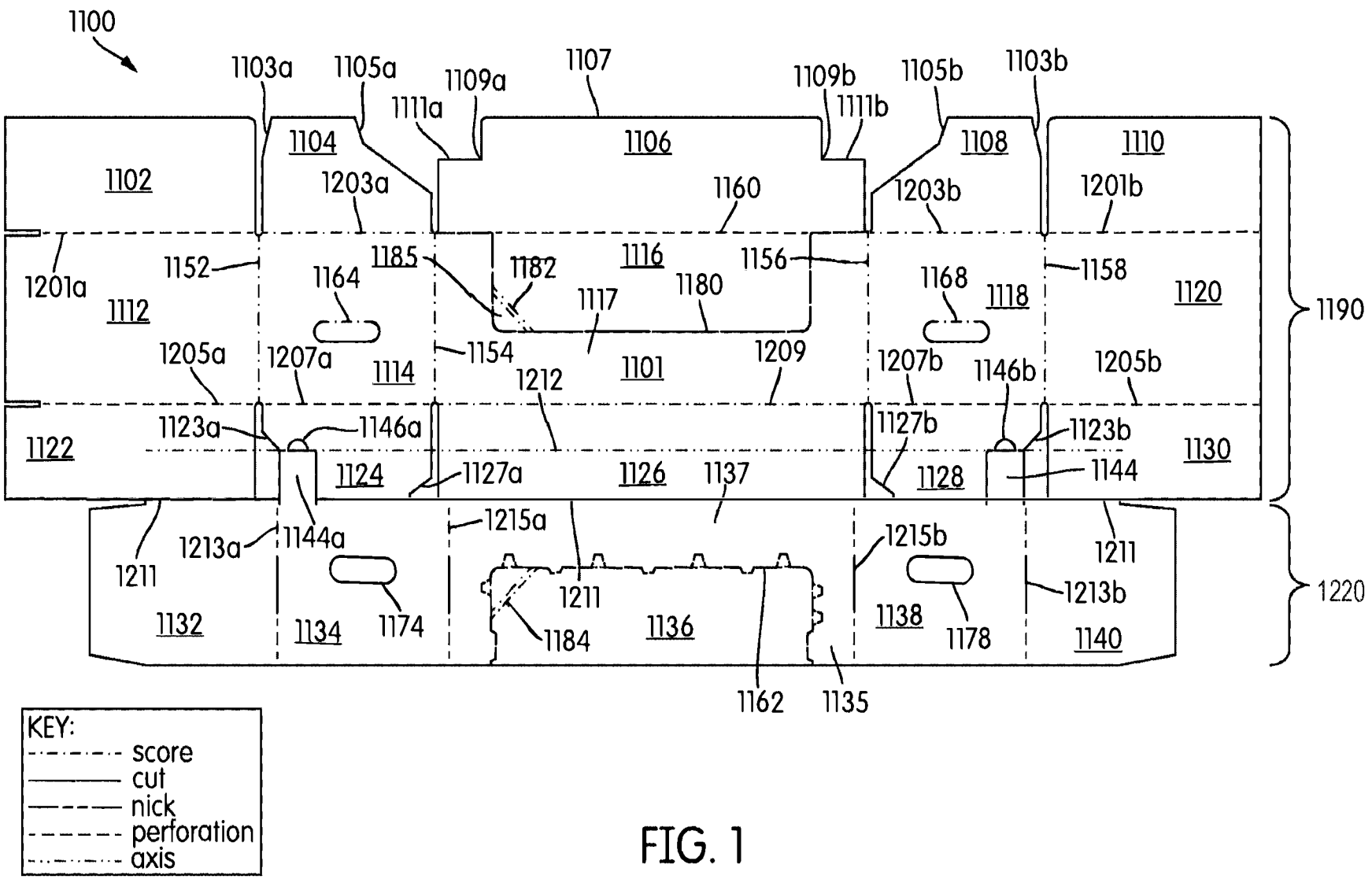
FIG. 1 is a plan view of a unitary blank according to a first exemplary embodiment of the present invention.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments, as described below and as defined by the claims which follow, comprise improvements to the structure and methods of making a container that is designed to be converted into a display.

Several specific aspects of the apparatus and methods of the present invention are outlined below.

Aspect 1: A container comprising:

an outer portion comprising an outer front panel having an outer fixed portion an outer removable portion, an outer left side panel extending from a left edge of the outer front panel, an outer right side panel extending from a right edge of the outer front panel, and at least one outer back panel, the outer front panel, the outer left side panel, the outer right side panel, and the at least one outer back panel forming an enclosed perimeter wall;

an inner portion comprising an inner front panel having an inner fixed portion and an inner removable portion, an inner left side panel, an inner right side panel, an inner left back panel, an inner right back panel, the inner front panel being affixed to the outer front panel, the inner back left back panel and the inner right back panel being affixed to the at least one outer back panel, the inner left side panel extending from the inner front panel to the inner left back panel in spaced apart relation to the outer left side panel, the inner right side panel extending from the inner front panel to the inner right back panel in spaced apart relation to the outer right side panel;

a top front major flap extending from one of the outer front panel and the inner front panel, a top left minor flap extending from the outer left side panel, a top right minor flap extending from the outer right side panel, and at least one top back major flap, each of the at least one top back major flap extending from one of at least one outer back panel, the top front major flap, a top left minor flap, the top right minor flap, and the at least one top back major flap being shaped and positioned to form a substantially enclosed top surface;

a bottom front major flap extending from one of the outer front panel and the inner front panel, a bottom left minor flap extending from the outer left side panel, a bottom right minor flap extending from the outer right side panel, and at least one bottom back major flap, each of the at least one bottom back major flap extending from one of at least one outer back panel, the bottom front major flap, a bottom left minor flap, the bottom right minor flap, and the at least one bottom back major flap being shaped and positioned to form a substantially enclosed bottom surface;

a removable window comprising the outer removable portion and the inner removable portion; and an inner separation line that defines a border between the inner fixed portion and the inner removable portion and an outer separation line that defines a border between the outer fixed portion and the outer removable portion.

Aspect 2: A method of forming a container, comprising:

(a) providing an outer portion comprising an outer front panel, an outer left side panel located adjacent to a left edge of the outer front panel, an outer right side panel located adjacent a right edge of the outer front panel, and at least one outer back panel, the outer front panel, the outer left side panel;

(b) providing an inner portion comprising an inner front panel having an inner fixed portion, an inner left side panel, an inner right side panel, an inner left back panel, an inner right back panel;

(c) providing a top front major flap extending from one of the outer front panel and the inner front panel, a top left minor flap extending from the outer left side panel, a top right minor flap extending from the outer right side panel, and at least one top back major flap, each of the at least one top back major flap extending from one of at least one outer back panel, the top front major flap, a top left minor flap, the top right minor flap, and the at least one top back major flap being shaped and positioned to form a substantially enclosed top surface;

(d) providing an outer separation line in the outer front panel that defines a border between an outer removable portion and an outer fixed portion;

(e) providing an inner separation line in the inner front panel that defines a border between an inner removable portion and an inner fixed portion;

(f) providing a bottom front major flap extending from one of the outer removable portion and the inner removable portion, a bottom left minor flap extending from the outer left side panel, a bottom right minor flap extending from the outer right side panel, and at least one bottom back major flap, each of the at least one bottom back major flap extending from one of at least one outer back panel, the bottom front major flap, a bottom left minor flap, the bottom right minor flap, and the at least one bottom back major flap being adapted to form a substantially enclosed bottom surface;

(g) positioning the inner portion atop the outer portion so that the inner removable portion overlaps with at least a portion of the outer removable portion;

(h) affixing the inner front panel to an inner side of the outer front panel in the position of step (g);

(i) affixing the inner left back panel and the inner right back panel to an inner side of the at least one outer back panel in a location that results in the inner left side panel extending from the inner front panel to the inner back left panel in spaced apart relation to the outer left side panel and the inner right side panel extending from the inner front panel to the inner back right panel in spaced apart relation to the outer right side panel; and (j) forming an enclosed perimeter wall comprising the outer front panel, the outer left side panel, the outer right side panel, and the at least one outer back panel.

Aspect 3: A container comprising:

an outer front panel having an outer fixed portion and an outer removable portion, an inner front panel having an inner fixed portion and an inner removable portion, an outer left side panel located adjacent to a left edge of the outer front panel, an outer right side panel located adjacent a right edge of the outer front panel, and at least one outer back panel, the outer front panel, the outer left side panel, the outer right side panel, and the at least one outer back panel forming an enclosed perimeter wall, the inner front panel being affixed to the outer front panel;

a top front major flap extending from one of the outer front panel and the inner front panel, a top left minor flap extending from the outer left side panel, a top right minor flap extending from the outer right side panel, and at least one top back major flap, each of the at least one top back major flap extending from one of at least one outer back panel, the top front major flap, a top left minor flap, the top right minor flap, and the at least one top back major flap being shaped and positioned to form a substantially enclosed top surface;

a floor that forms a substantially enclosed bottom surface;

a removable window comprising the inner removable portion and the outer removable portion;

a plurality of projections, each of the plurality of projections being part of one of an inner separation line and an outer separation line;

wherein when the removable window is separated from the container, the removable window is adapted to separate from the outer fixed portion along the outer separation line and to separate from the inner fixed portion along the inner separation line;

wherein when the removable window is attached to the container, any of the plurality of projections that is part of the outer fixed portion overlap with the inner removable portion, any of the plurality of projections that is part of the outer removable portion overlaps with the inner fixed portion, any of the plurality of projections that is part of the inner fixed portion overlap with the outer removable portion, any of the plurality of projections that is part of the inner removable portion overlaps with the outer fixed portion.

Aspect 4: A corrugated fiberboard blank comprising:

an outer portion comprising an outer front panel having an outer fixed portion and an outer removable portion, an outer left side panel located adjacent to a left edge of the outer front panel, an outer right side panel located adjacent a right edge of the outer front panel, a left outer back panel located adjacent to a left edge of the outer left side panel, a right outer back panel located adjacent to a right edge of the outer right side panel;

the outer front panel, the outer left side panel, the outer right side panel, and the at least one outer back panel forming an enclosed perimeter wall;

an inner portion comprising an inner front panel having an inner fixed portion and an inner removable portion, an inner left side panel adjacent to a left edge of the inner front panel, an inner right side panel adjacent to a right edge of the inner front panel, an inner left back panel adjacent to a left edge of the inner left side panel, an inner right back panel adjacent to a right edge of the inner right side panel, a top front major flap extending attached at an upper edge of one of the outer front panel and the inner front panel, a top left minor flap extending from an upper edge of the outer left side panel, a top right minor flap extending an upper edge of the outer right side panel, a left top back major flap extending from an upper edge of the left outer back panel, a right top back major flap extending from an upper edge of the right outer back panel, a bottom front major flap extending from a bottom edge of the outer front panel, a bottom left minor flap extending from a bottom edge of the outer left side panel, a bottom right minor flap extending from a lower edge of the outer right side panel, a left bottom back major flap extending from a bottom edge of the left outer back panel, a right bottom back major flap extending from a bottom edge of the right outer back panel;

an outer separation line that defines a border between the outer fixed portion and the outer removable portion, an inner separation line the defines a border between the inner fixed portion and the outer removable portion;

a plurality of connection tabs that connect the inner portion to the outer portion, each of the plurality of tabs being located within one of the bottom right minor flap and the left bottom back major flap;

wherein the inner portion is connected to the outer portion only by the plurality of connection tabs.

DETAILED DESCRIPTION OF THE INVENTION

The ensuing detailed description provides preferred exemplary embodiments and/or example configurations illustrating features and combinations of features of the inventions, and is not intended to limit the scope, applicability, or configuration of the herein disclosed inventions. Rather, the ensuing detailed description of the preferred exemplary embodiments and example configurations will provide those skilled in the art with an enabling description for implementing preferred exemplary embodiments and other example configurations in accordance with the invention. It is understood that various changes maybe made in the function and arrangement of elements, the features and combination of features and other aspects of the invention without departing from the spirit and scope of the invention, as set forth in the appended claims.

To aid in describing the invention, directional terms may be used in the specification and claims to describe portions of the present invention e.g., upper, lower, left, right, etc., which generally applies to the box or components when oriented in their typical usage configuration, such as with the bottom of the box being oriented in a horizontal direction or with the blank lying flat. These directional definitions are merely intended to assist in describing and claiming the invention and are not intended to limit the invention in any way. In addition, reference numerals that are introduced in the specification in association with a drawing figure may be repeated in one or more subsequent figures without additional description in the specification, to provide context for other features.

Embodiments and example configurations of the present invention disclosed herein describe a multipurpose box designed for storing, shipping and displaying items offered for sale in retail stores. The box is strong, cost effective to manufacture, stackable, and easily and reliably convertible into a retail display. The box may be constructed from one or more corrugated fiberboard blanks or other similar material. The blanks and/or KDFs and/or containers of the embodiments and configurations described herein are typically manufactured using corrugated fiberboard, for example. It is to be understood that the principles in one or more of the embodiments and/or configurations of this disclosure may be made to containers made of other materials, shapes or styles.

As used herein, the terms "adhered" or "affixed" (and other formatives of these terms) are intended to mean that one surface is attached to another using an adhesive, such as glue, tape, cement, or paste. The adhesive may be placed on either one or both of the surfaces being adhered. Adhesive materials are represented in the drawings as "X"s or striped tape.

As used herein, the terms "major" or "minor" are intended to mean the larger dimension of an element or group of elements. For example, a minor flap is shorter in length than a major flap for that same container.

As used herein, the term "blank" means a planar piece of material that has been cut into a shape that is then used to create a container.

As used herein, a "unitary blank" means a blank that consists of single sheet of material, for example corrugated fiberboard, at the start of assembly process. In the case of a multi-layer box (such as those disclosed in this application), all of the layers are included in the unitary blank and none of the layers that form part of the finished box are separated from each other before being positioned and affixed to each other.

As used herein the terms "cut" and "cut line" mean a continuous incision in the material which penetrates the entire thickness of the material.

As used herein the term "perforation" means an alternating pattern of cuts and connected portions in the material. As used herein, the term "nick" means a portion of 15 material, preferably between 1/32 and 1/8 inch in width, which connects two adjacent portions of a material and is located along a line along which the two pieces of material are cut apart. A "nick" is distinguished from a perforation in that each nick is located along a line or curve in which the materials are separated by cut portions on either side of the nick and the cut portions are preferably at least five times (more preferably, at least ten times) the width of each nick. Perforations are characterized by alternating connected and cut portions which are much more proportional in size (typically a width difference of no more than 2-3 times between connected portions and cut portions). A nick can be formed by grinding away a small portion of the cutting die knife rule.

As used herein the terms "score" and "score line" mean a crease or shallow cut that does not fully penetrate the entire thickness of the material which serves to make folding the material easier along the score line than along an unscored line. The score acts as a joint in the material, along which portions of the material may be more easily folded.

As used herein, the term "separation line" means a line or curve formed of any combination of cut, nicked, and perforated portions that defines a border between two adjacent, connected elements. The weakened connection provided by the separation line enables the elements adjacent to the separation line to be more easily and predictably separated along the separation line than if the separation line were not present.

As used herein, the term "corrugated" means a material consisting primary of a fluted corrugated sheet and at least one flat linerboard.

Figure 2:
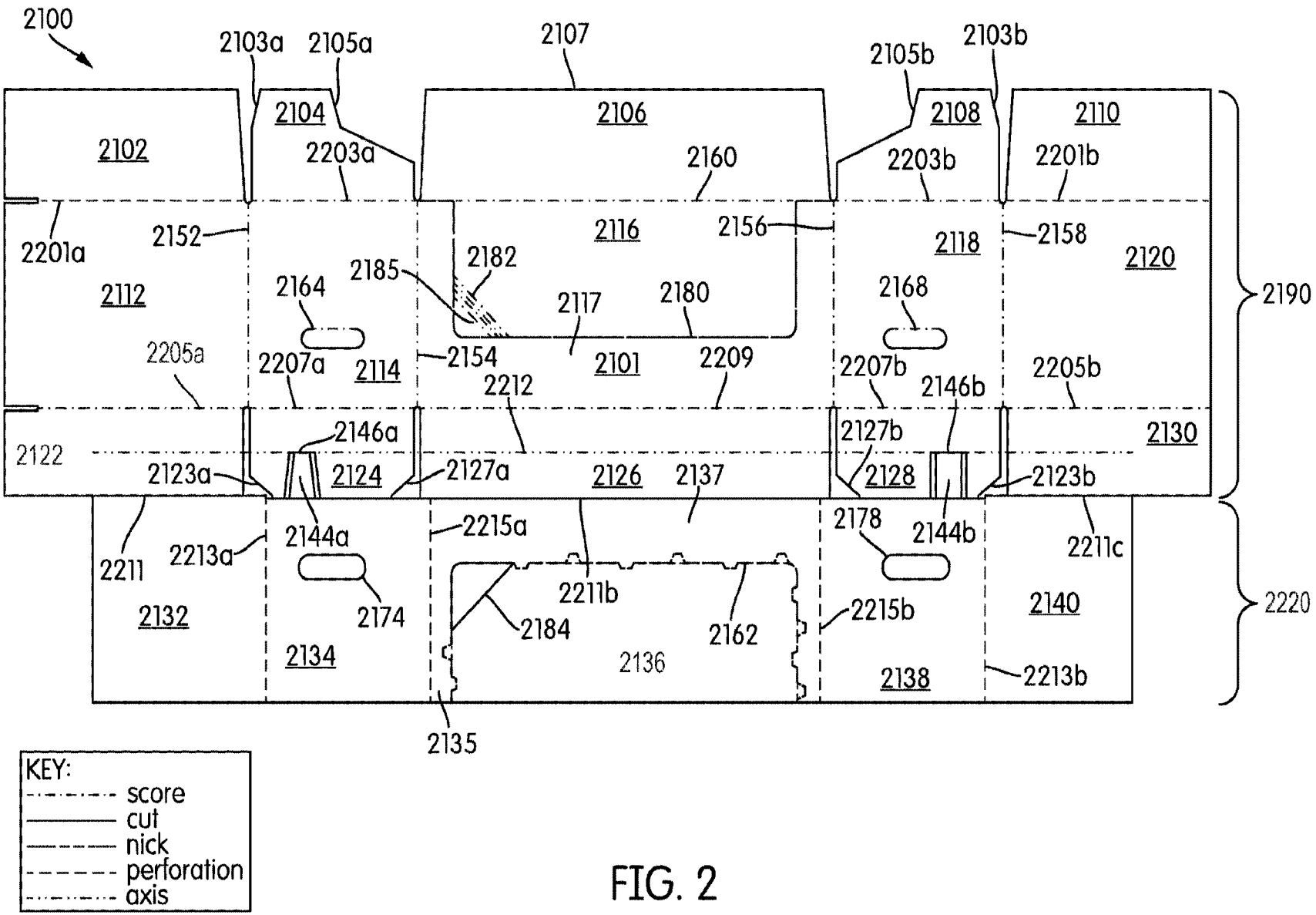
FIG. 2 is a plan view of a unitary blank according to a second exemplary embodiment of the present invention.

A first exemplary embodiment of a blank 1100 that is used to form a container is shown in FIG. 1. FIG. 1 shows the pattern of panels, flaps, cuts, perforations, nicks and scores which are created in the corrugated material to create the blank 1100, which will be folded into a KDF, and can subsequently be assembled into a box. In this example, blank 1100 is a single, unitary blank. The blank 1100 includes an inner portion 1220 and an outer portion 1190. As described in greater detail below, the inner portion 1220 is contained within the outer portion 1190 when the box is fully assembled. FIG. 2 shows a second embodiment of a blank 2100 of the present invention which is also created from a unitary blank and has the same configuration panels and flaps as the blank 1100 of FIG. 1. An advantage of using a unitary blank is that it simplifies the KDF assembly process by eliminating the need to align separate blanks when forming a multi-layer box.

The blank 1100 is preferably scored along joints 1152, 1154, 1156, 1158, 1160, 1201, 1203, 1205, 1207 and 1209 to form panels which, when folded along the scored lines, will form the side panels, end panels, top flaps and bottom of the box. The scored lines serve as joints such that adjacent panels of the blank may be folded along the scored lines such that a substantially right angle exists at each joint. Some structural features may utilize joints forming angles which are not substantially right angles. Joints and other features of the box may alternatively make use of cuts, nicks and perforations in the blank. It should be noted that, in order to comply with the limitations of black and white formal patent drawings, the symbols used in the drawings to identify scores, cuts, nicks, and perforations are different that those typically used in technical drawings in the art.

Each panel and flap of the blank 1200 has an inside and outside surface. When the box is assembled, the inner portion 1220 is generally contained within the outer portion 1190. Unless otherwise specified herein "inner" and "outer" refer to the relative position of blanks, panels and other features when the box is fully assembled and erected.

The outer portion 1190 includes a plurality of panels in a generally linear arrangement. In other words, the uppermost and lowermost edges of all of the panels in the outer portion 1190 are preferably aligned. An outer front panel 1101 having an outer fixed portion 1117 and an outer removable portion 1116 is centrally located in the outer portion 1190. An outer left side panel 1114 is located to the left of the outer front panel 1101 and is attached thereto along joint 1154. An outer right side panel 1118 is located to the right of the outer front panel 1101 and is attached thereto along joint 1156. A left outer back panel 1112 is located to the left of the outer left side panel 1114 and is attached thereto along joint 1152. A right outer back panel 1120 is located to the right of the outer right side panel 1118 and is attached thereto along joint 1158. When the container is fully assembled, the left outer back panel 1112 and right outer back panel 1120 are affixed to one another to collectively form a back panel. In addition, the left outer back panel 1112, the outer left side panel 1114, the outer front panel 1101, the outer right side panel 1118, and the right outer back panel 1120 collectively form an enclosed perimeter wall when the container is fully assembled.

The outer portion 1190 also includes a top flap extending upwardly from each of the outer panels and a bottom flap extending downwardly from each of the outer panels. A top front major flap 1106 extends upwardly from the outer front panel 1101 and is attached thereto along joint 1160. In an alternate embodiment, it would be possible to have the top front major flap extend upwardly from the inner front panel 1135. A top left minor flap 1104 extends upwardly from the outer left side panel 1114 and is attached along joint 1203*a*. A top right minor flap 1108 extends upwardly from the outer right side panel 1118 and is attached along a joint 1203*b*. A left top back major flap 1102 extends upwardly from the left outer back panel 1112. A right top back major flap 1110 extends upwardly from the right outer back panel 1120 and is attached thereto along joint 1201*a*.

As will be described in greater detail herein, the top front major flap 1106 includes cut-away portions 1109*a*, 1109*b* in upper left and right corners of the top front major flap 1106. These cut-away portions 1109*a*, 1109*b* each define a bearing edge 1111*a*, 1111*b* that is below the uppermost edge 1107 of the outer portion 1190 and abuts edges of the top rear major flap when the container is fully assembled and the top rear major flap is taped down.

The top left minor flap 1104 and the top right minor flap 1108 each include outer edges having portions 1103*a* and 1103*b* that taper inwardly in the direction of the uppermost edge of the blank 1100. These tapered portions 1103*a*, 1103*b* reduce the likelihood of the outer edges being curled upwardly when tape is applied to the top flaps by a tape roller.

When the container is fully assembled, the left top back major flap 1102 and the right top back major flap 1110 collectively form the top back major flap. In addition, the top front major flap 1106, the top left minor flap 1104, the top right minor flap 1108, left top back major flap 1102, and the right top back major flap 1110 are shaped and positioned to form the top of the container and provide a substantially enclosed top surface when all are folded inwardly and secured in the folded position. As used in the specification and claims, "substantially enclosed" means a surface having no openings with a major dimension larger than 1.0 cm.

The outer portion 1190 also includes a bottom flap extending downwardly from each of the outer panels. A bottom front major flap 1126 extends downwardly the outer front panel 1101 and is affixed thereto along joint 1209. A bottom left minor flap 1124 extends downwardly from the outer left side panel 1114 and is attached thereto along joint 1207*a*. A bottom right minor flap 1128 extends downwardly from the outer right side panel 1118 and is attached thereto along joint 1207*b*. A left bottom back major flap 1122 extends downwardly from the left outer back panel 1112 and is attached thereto along joint 1205*a*. A right bottom back major flap 1130 extends downwardly from the right outer back panel 1120 and is attached thereto along joint 1205*b*.

When the container is fully assembled, the left bottom back major flap 1122 and the right bottom back major flap 1130 collectively form the bottom back major flap. In addition, the bottom front major flap 1126, the bottom left minor flap 1124, the bottom right minor flap 1128, left bottom back major flap 1122, and the right bottom back major flap 1130 are shaped and positioned to form the bottom of the container and provide a substantially enclosed bottom surface when all are folded inwardly and secured in the folded position.

The inner portion 1220 also includes a plurality of panels in a generally linear arrangement. An inner front panel 1135 is centrally located in the inner portion 1220. An inner left side panel 1134 extends to the left of the inner front panel 1135 and is attached thereto along joint 1215*a*. An inner right side panel 1138 extends to the right of the inner front panel 1135 and is attached thereto along joint 1215*b*. A left inner back panel 1132 extends to the left of the inner left side panel 1134 and is attached thereto along joint 1213*a*. A right inner back panel 1140 extends to the right of the inner right side panel 1138 and is attached thereto along joint 1213*b*.

The outer front panel 1101 includes an outer fixed portion 1117 and a removable portion 1116. An outer separation line 1180 defines the border between the outer fixed portion 1117 and a removable portion 1116. Similarly, the inner front panel 1135 includes a fixed portion 1137 and a removable portion 1136. An inner separation line 1162 defines the border between the fixed portion 1137 and a removable portion 1136. When the container is fully assembled, the removable portions 1116, 1136 form part of a window that is removed when the container is opened on a display.

The outer removable portion 1116 of the outer front panel 1101 includes a pair of parallel scored lines 1182. A similar pair of parallel scored lines 1184 is located on the inner removable portion 1136 of the inner front panel 1135, positioned to overlap with the pair of parallel scored lines 1182 when the inner front panel 1135 is affixed to the outer front panel 1101 (as described herein). This feature enables a user to push his or her hand through a corner portion 1185 which folds along the parallel scored lines 1182, thereby creating a handle that can be used to pull the removable window up and away from the container while protecting the user's hands from edges of the removable portion. This feature also enables the removable window to be removed more easily without cutting tools and works well with additional inventive features discussed herein. In an alternate embodiment, the inner removable portion 1136 could remove the corner portion, leaving a space behind the corner portion 1185 of the outer removable portion 1116.

A left pivot arm 1144*a* is contained within the bottom left minor flap 1124 and connects an upper edge of the inner left side panel 1134 to the bottom left minor flap 1124 along a left pivot connection joint 1146*a*. Similarly, a right pivot arm 1144*b* is contained within the bottom right minor flap 1128 and connects an upper edge of the inner right side panel 1138 to the bottom right minor flap 1128 along a left pivot connection joint 1146*b*. As will be described herein, the left and right pivot connection joints 1146*a*, 1146*b* define a pivot axis 1212, about which the inner portion 1220 is folded as part of the assembly of the blank 1100 into a knock down flat.

A handle 1174 is cut into the inner left side panel 1134 and a separation line 1164 located in the outer left side panel 1114, which defines a similarly-shaped handle that folds inwardly and upwardly when pressed in. The handle 1174 is located in a position so that it overlaps with the separation line 1164 when the container is fully assembled.

A handle 1178 is cut into the inner right side panel 1138 and a separation line 1168 located in the outer right side panel 1118, which defines a similarly-shaped handle that folds inwardly and upwardly when pressed in. The handle 1178 is located in a position so that it overlaps with separation line 1168 when the container is fully assembled.

Referring now to FIG. 2, a unitary blank 2100 is generally shown according to an embodiment of the invention for forming a storage, shipping and display box having a stacked arrangement of two blank layers along portions of the box, including at least along a front wall of the box. Blank 2100 is formed as a unitary blank that is configured to be folded along an offset pivot line to form a blank having stacked portions with two layers stacked over each other connected to each other at least along a front wall panel portion of the blank. The blank has an inner portion 2220 and outer portion 2190.

FIGS. 3 through 9 show steps in the method by which the blank 2100 is assembled into a KDF. An identical method could be used to assemble blank 1100 into a KDF.

Figure 3:
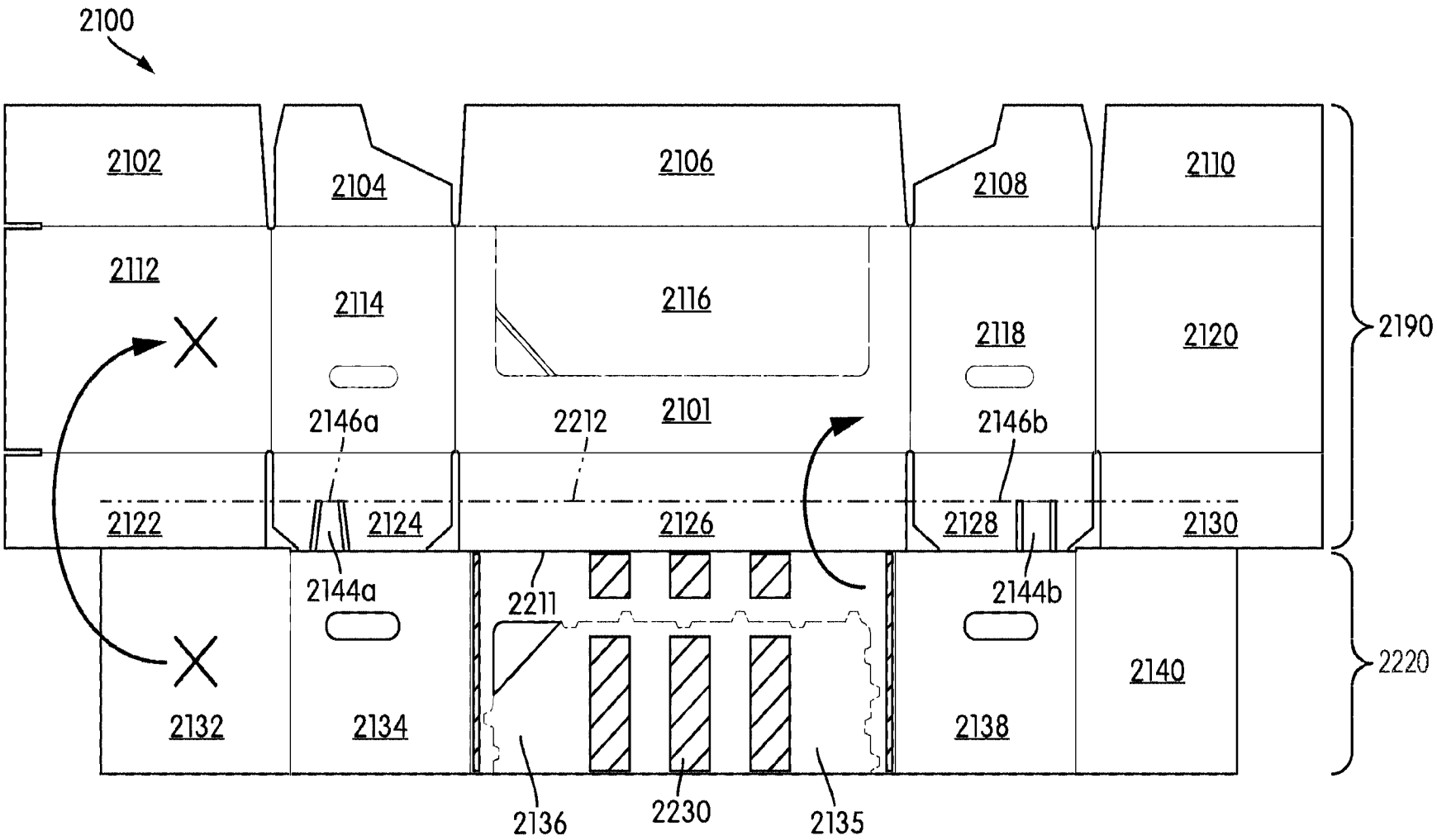
FIG. 3 is a plan view of the blank of FIG. 2, shown with adhesive applied to the inner front panel and showing the axis along about which the inner portion is rotated in order to position it atop the outer portion.

The outer portion 2190 is separated from the inner portion 2220 by a cut line 2211 extending across a width of blank 2100, except where the left and right pivot arms 2144*a*, 2144*b* connect to the inner portion 2220. As described above with respect to blank 1100, the left and right pivot connection joints 2146*a*, 2146*b* define a pivot axis 2212, about which the inner portion 2220 is folded. As indicated by the curved arrows in FIG. 3, showing the direction of rotation of inner portion 2220, the inner portion 2220 folded over along the pivot axis 2212 connections 2146 located at the distal ends of pivot arms 2144*a*, 2144*b*, such that the inner portion 2220 is positioned atop, and properly aligned with, the outer portion 2190 (see FIG. 4).

The pivot arms 2144*a*, 2144*b* allow the inner portion 2220 to be rotated in a manner that is predictable, but offset from the cut line 2211 separating the outer portion 2190 from the inner portion 2220. This offset folding arrangement allows both the outer portion 2190 from the inner portion 2220 to be formed from a single, unitary blank, which significantly simplifies the manufacturing and assembly of the blank to provide a box blank having two layers stacked on each other without incurring the additional costs of manufacturing and assembling two separate blanks.

An adhesive, such as glue or strips of double-sided tape 2230*a* is applied to the inner front panel 2135 so that the inner front panel 2135 becomes affixed to the outer front panel 2101 when folded over. It is preferable that adhesive be located on both the inner fixed portion 2137 and the inner removable portion 2136 so that both are securely affixed. It is also preferable that any tape strips not cross the inner separation line 2162, so as to not impede removal of the removable window, when desired.

Figure 4:
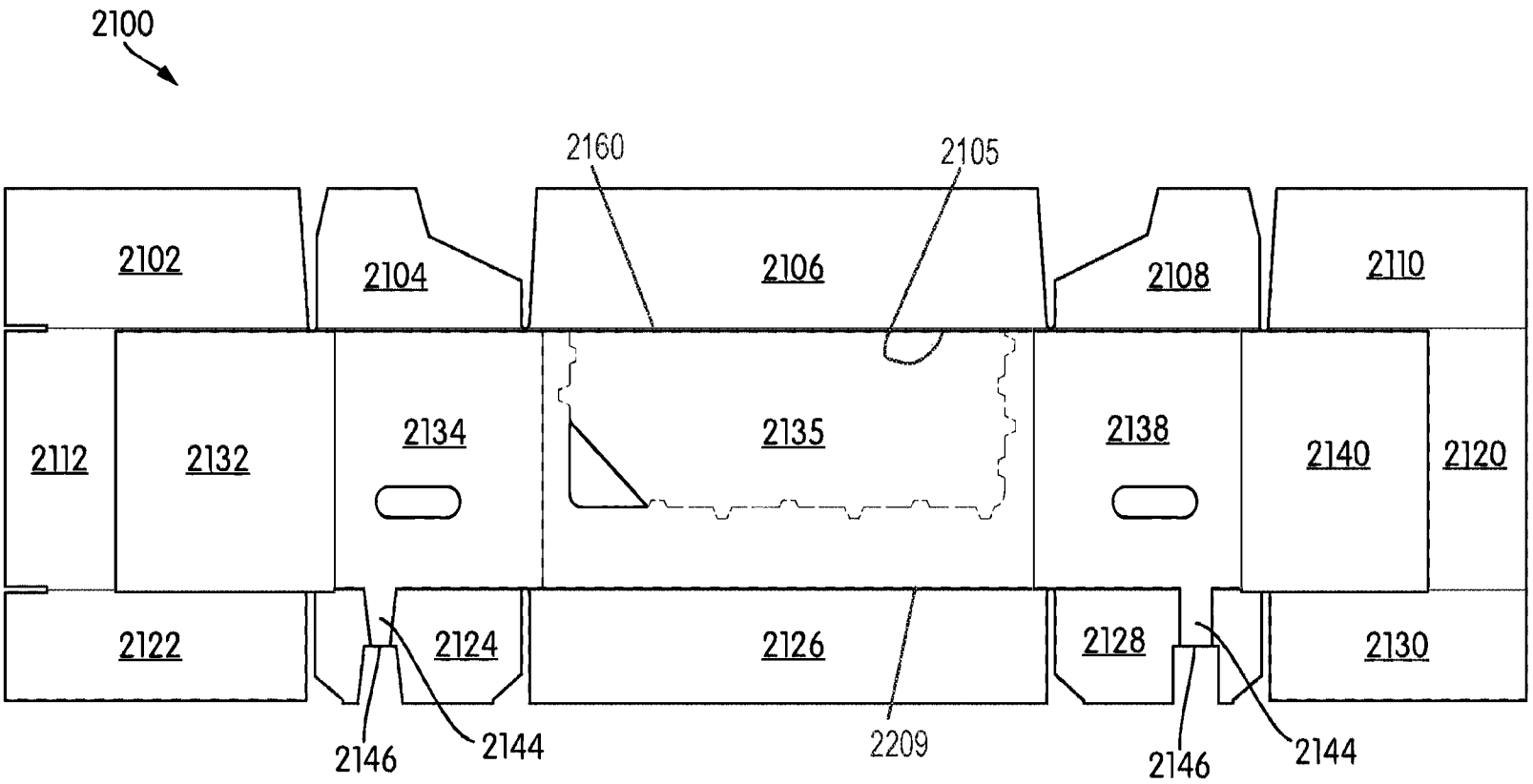
FIG. 4 is a plan view of the blank of FIG. 2, shown with the inner portion having been folded and positioned atop the outer portion.

FIG. 4 shows the blank 2210 with the inner portion 2220 folded over the outer portion 2190. The inner portion 2220 is preferably aligned with the outer portion 2290 so that the inner portion 2220 is parallel to the outer portion 2290 and the inner portion 2220 is preferably positioned between joints 2160 and 2126. Moreover, the upper edge of the inner portion 2220 (identified by reference number 2105 in FIG. 4) is preferably positioned below the joint 2160 that separates the outer front panel 2101 from the top front major flap 2106. More preferably, the upper edge 2105 of the inner portion 2220 is preferably positioned below the joint 2160 by a distance equal to one to three times (most preferably about one times) the thickness of the outer portion 2190. This offset enables the left and right top minor flaps 2104, 2018 to sit lower when folded inwardly, providing a flatter top surface for the container and provide improved strength characteristics for the fully assembled container.

Figure 5:
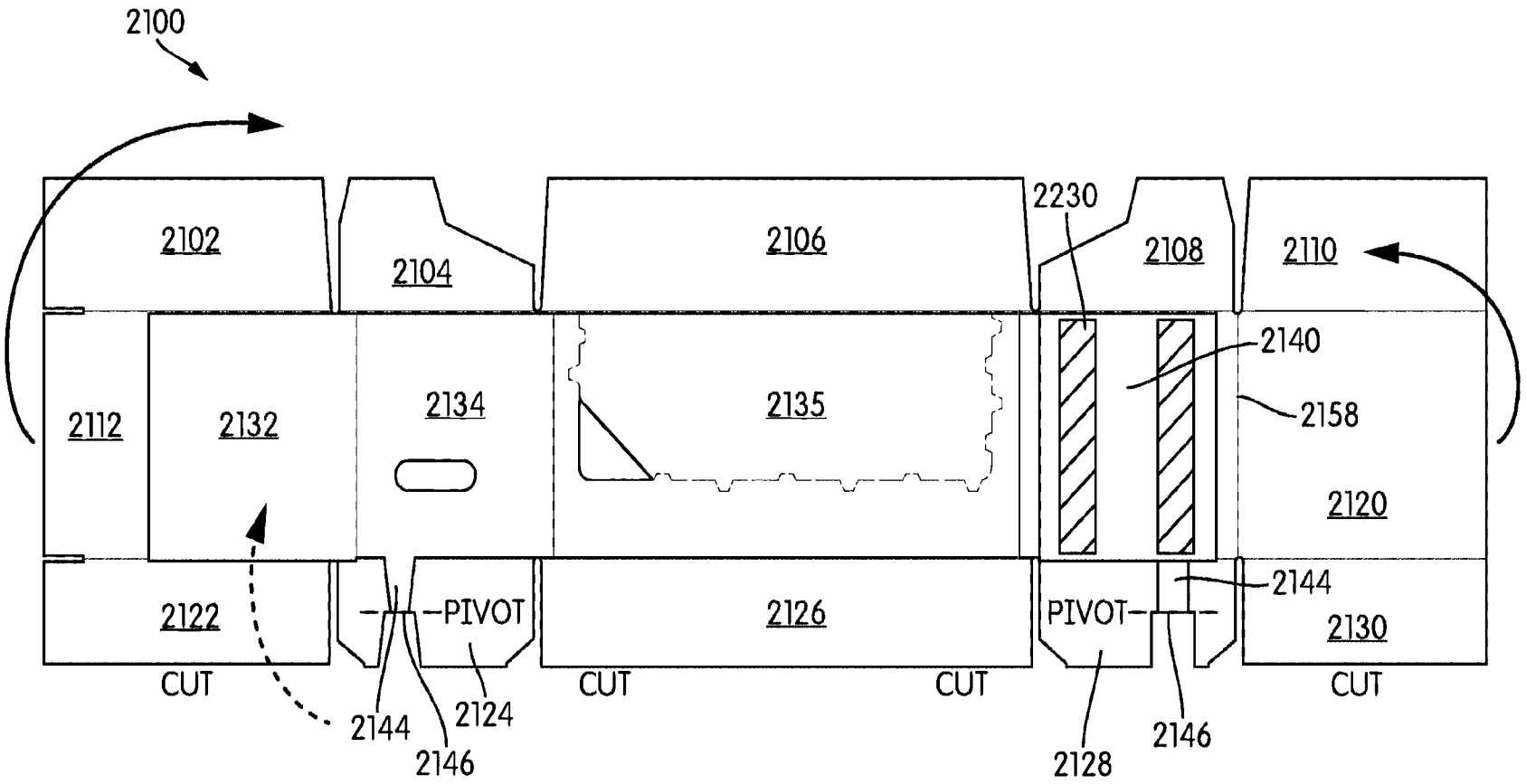
FIG. 5 is a plan view of the blank of FIG. 2, shown with the inner right back panel folded over the inner right side panel.
Figure 6:
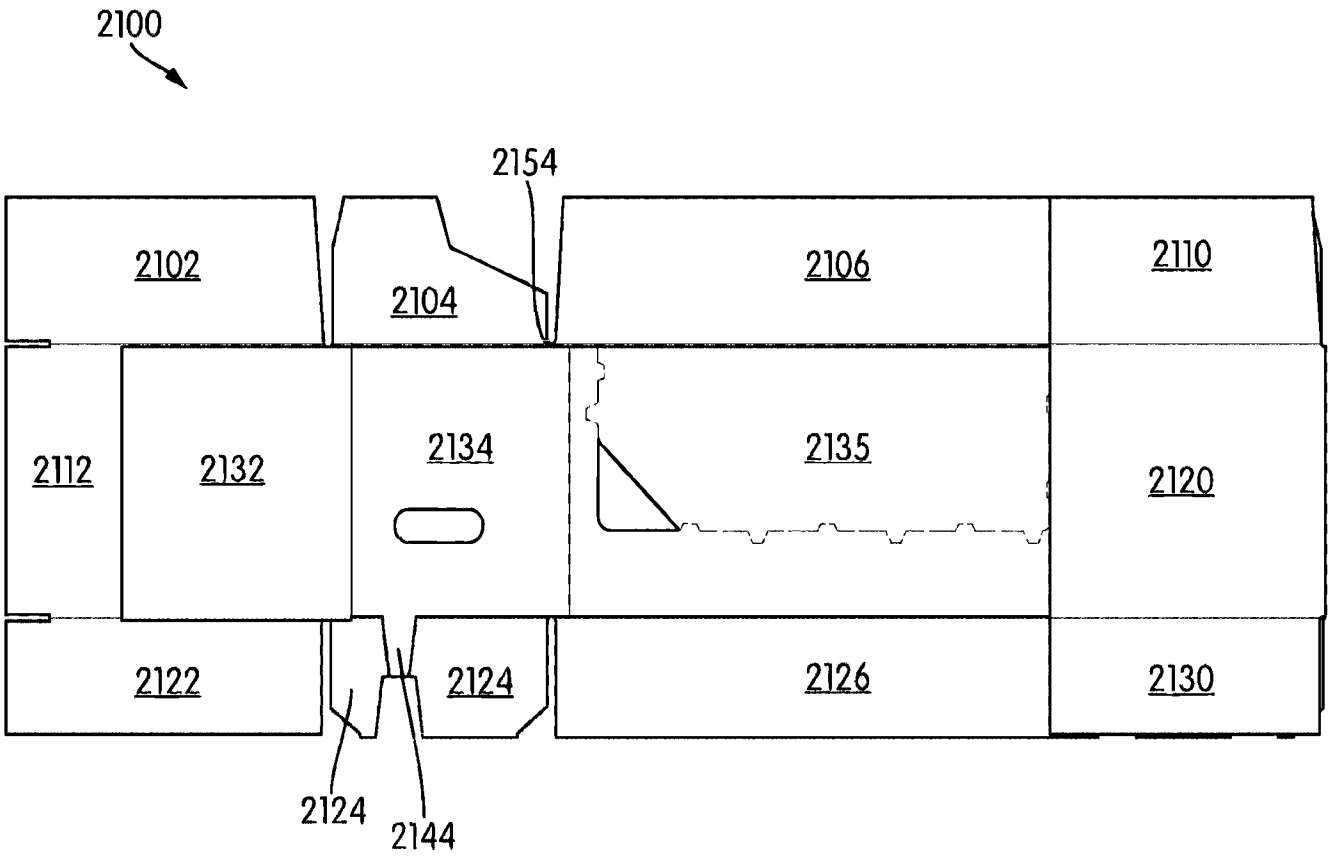
FIG. 6 is a plan view of the blank of FIG. 2, shown with the outer right back panel folded over the outer and inner right side panels.

FIG. 5 shows the next steps in forming the KDF. The right inner back panel 2140 is folded over the inner right side panel 2138 along joint 2213*b* (see FIG. 2). Adhesive is then applied to the outer side of the right inner back panel 2140, as shown by the striped areas 2230*b*. The right outer back panel 2120 is then folded inwardly along joint 2158, in the direction indicated by the arrow at the right side of the FIG. 5, where it is affixed to the right inner back panel 2140, as shown in FIG. 6.

Figure 7:
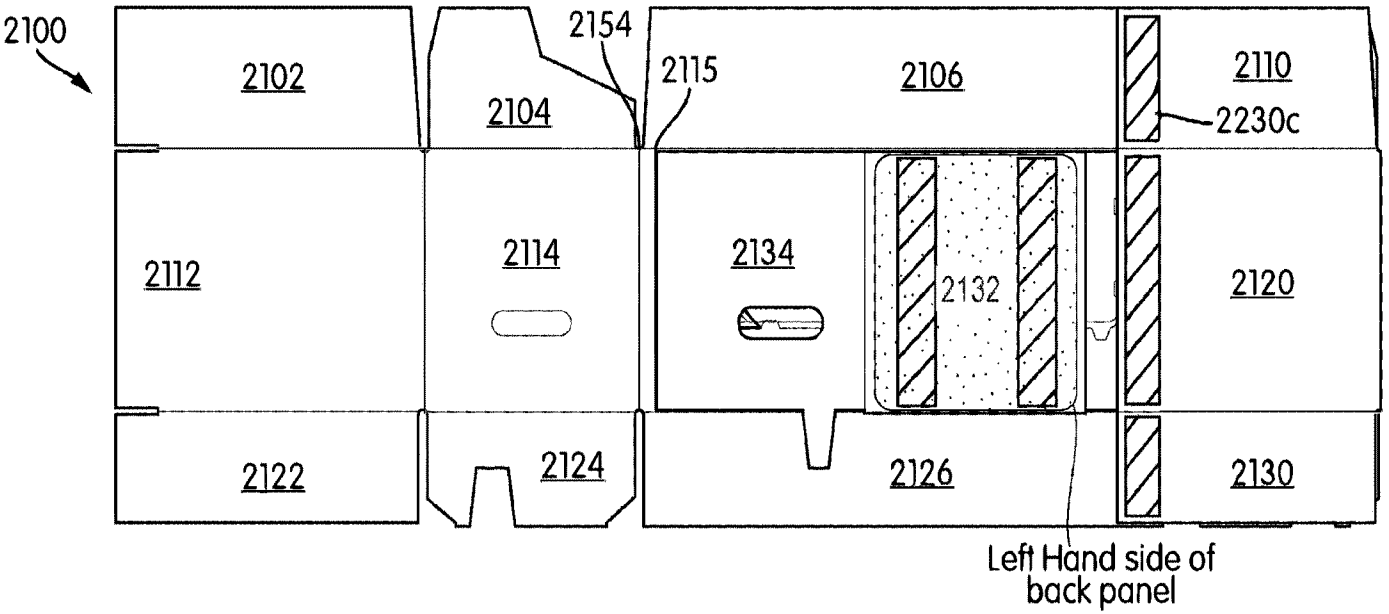
FIG. 7 is a plan view of the blank of FIG. 2, shown with the inner left side panel folded inwardly along a joint between the inner left side panel and the inner front panel.

Referring to FIG. 7, the left outer back panel 2112 is then folded along joint 2154 in the direction shown by the arrow at the left-hand side of the FIG. 5, then unfolded. During the fold, the perforation between pivot arm 2144 and the bottom left minor flap 2124 will break, as shown in FIG. 7. The inner left side panel 2134 and left inner back panel 2132 are then folded over along joint 2215*a*. Adhesive is then applied to the right outer back panel 2120 and the left inner back panel 2132 as shown by the striped areas 2230*c*. The outer left side panel 2114 and left outer back panel 2112 are then folded along joint 2154, which results in the left outer back panel 2112 becoming affixed to the right outer back panel 2120 and the left inner back panel 2132 to form the finished KDF. Once affixed to each other, the left outer back panel 2112 and the right outer back panel 2120 combine to form the outer back panel of the container.

Figure 8:
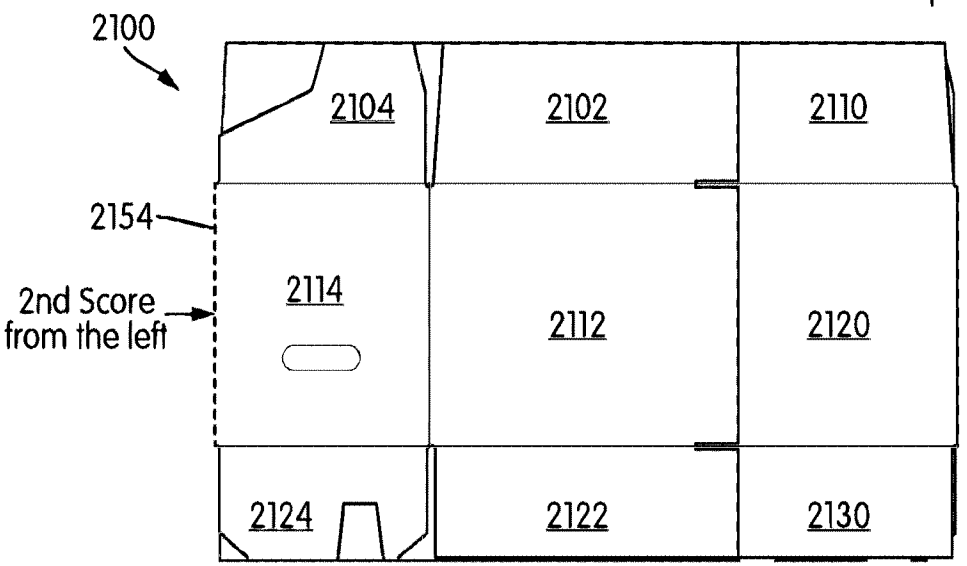
FIG. 8 is a plan view of the blank of FIG. 2, shown with the outer left side panel folded along a joint between the outer left side panel and the outer front panel, which is a now a fully assembled know down flat.

The finished KDF can be assembled into a box by squaring the sides to form a box (see FIG. 8). In assembled form, the outer right side panel 2118 and outer left side panel 2114 form substantially right angles with the outer front panel 2101.

Figure 9:
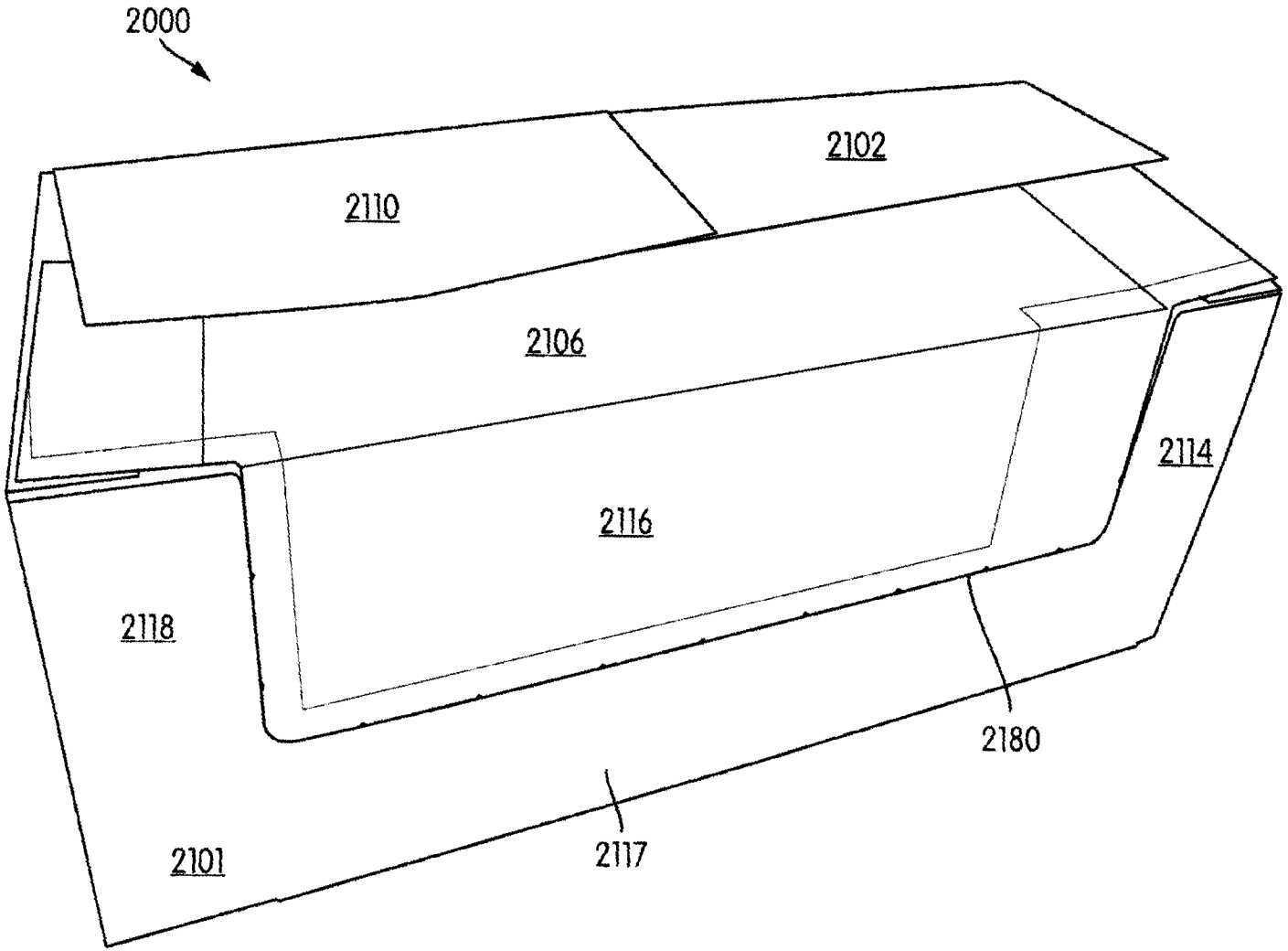
FIG. 9 is a front right perspective view of a fully assemble box constructed from the blank of FIG. 2 and erected from the knock down flat of FIG. 8.

It should be noted that the KDF shown in FIG. 8 is a right handed KDF, meaning that the right side of the KDF is lifted to erect the KDF and from an assembled box (see FIG. 9). The same blank 2210 can be used to form a left-handed KDF simply be reversing each of the steps performed in FIGS. 5-8 to the opposite side (i.e., each step performed on a left side is performed on the right side, and vice-versa).

Figure 10:
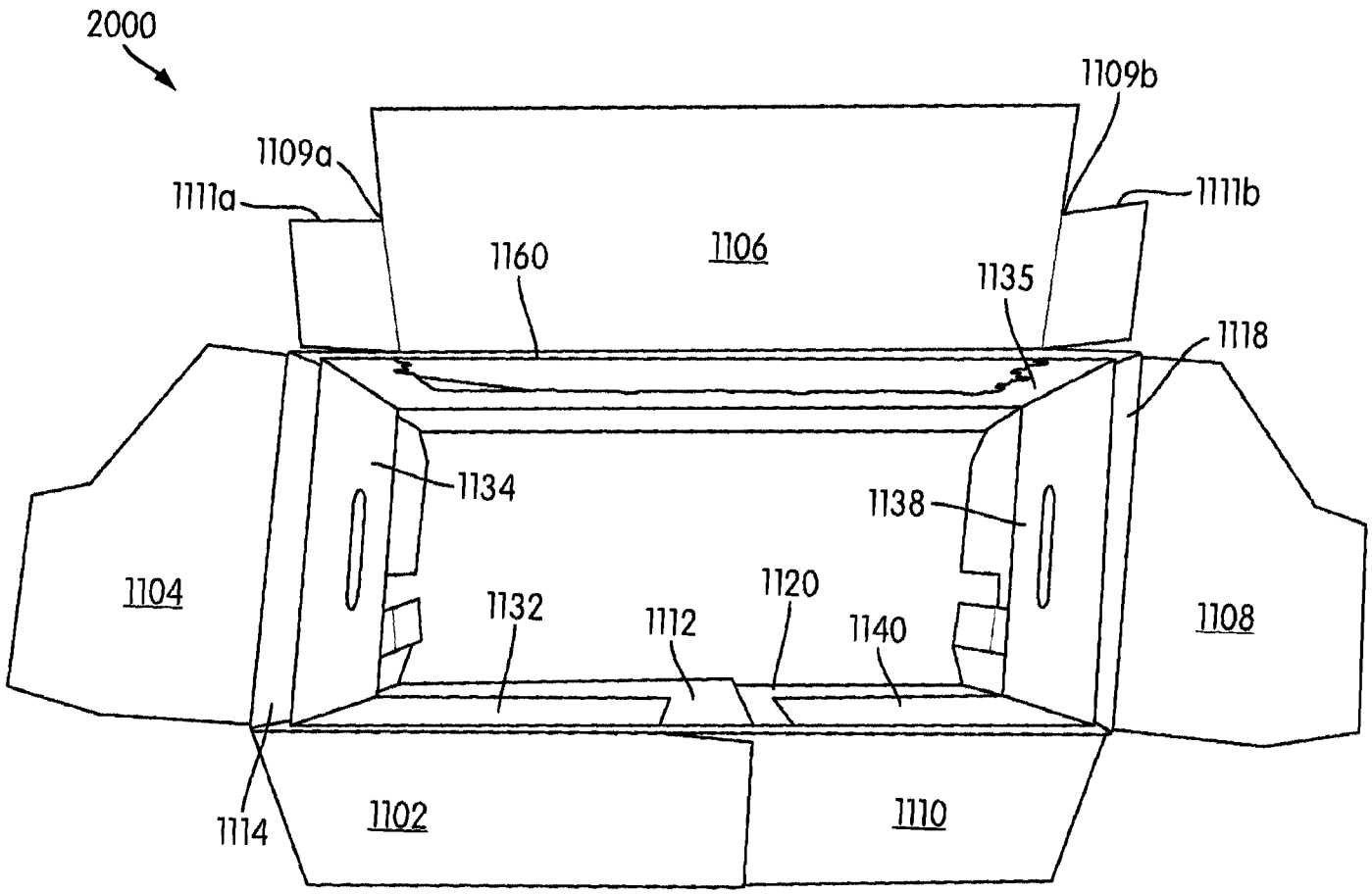
FIG. 10 is a top view of the assembled box of FIG. 9, shown with the top flaps open.

FIG. 10 provides an interior view of a container 1000 assembled from the blank 1100 according to the first embodiment of the invention, as seen in FIG. 1. As can be seen in FIG. 10, the left and right inner side panels 1134, 1138 extend from the inner front panel 1135 to the left and right inner rear panels 1132, 1140 in spaced apart relation to the outer left and right side panels 1114, 1118. In this context, "spaced apart relation" means that the left and right inner side panels 1134, 1138 are spaced apart from (i.e., not in contact with) outer left and right side panels 1114, 1118 along their entire length. In this embodiment, the left and right inner rear panels 1132, 1140 are parallel to the outer left and right side panels 1114, 1118, respectively. This configuration adds stability to the box, particularly when multiple boxes are stacked upon each other.

Figure 11:
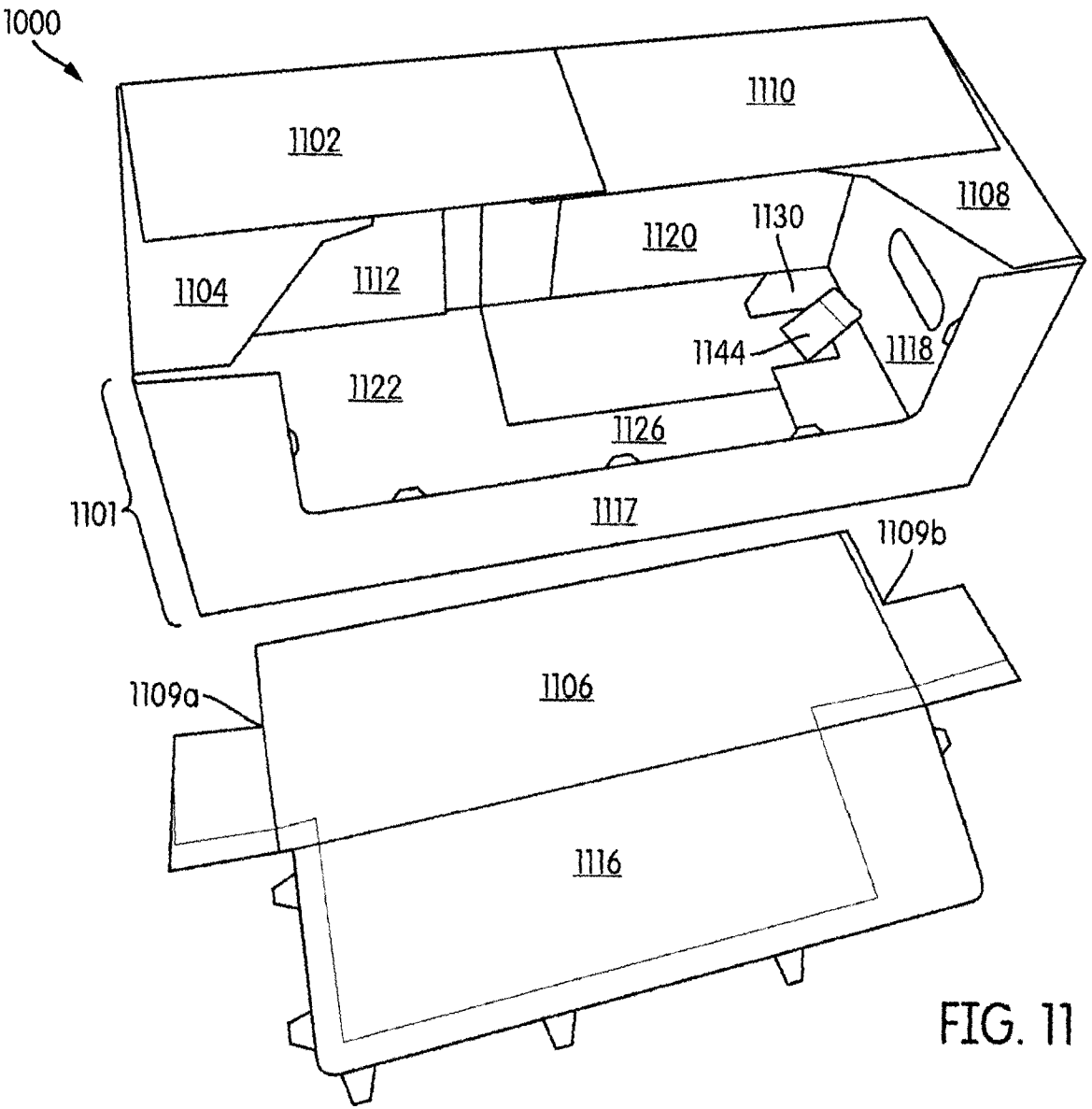
FIG. 11 is a front right perspective view of the container of FIG. 9, shown with the window removed.

FIG. 11 shows the container 1000 with the removable window, which includes the inner and outer removable portions 1136,1116 and the top front major flap 1106. As can be seen in FIG. 11, the structure of the removable window and the separation lines 1162, 1180 as described above, enables the window to be removed easily, without cutting tools, and leaves a clean edge behind.

As best seen in FIGS. 10 and 11, container 1000 is an entirely self-contained structure, providing side walls, a top surface, and a bottom surface without any additional components such as a top, cover, attachment or accessories. Further, container 1000 preferably includes a removable window 1216 formed in an upper, central section of the outer front panel 1101, which extends upward to include the top front major flap 1106, and which is preferably easily removed from box 12100 along with the inner removable window (not visible in these figures, to convert the container 1000 from a shipping and storage configuration into a display configuration.

Figure 12A:
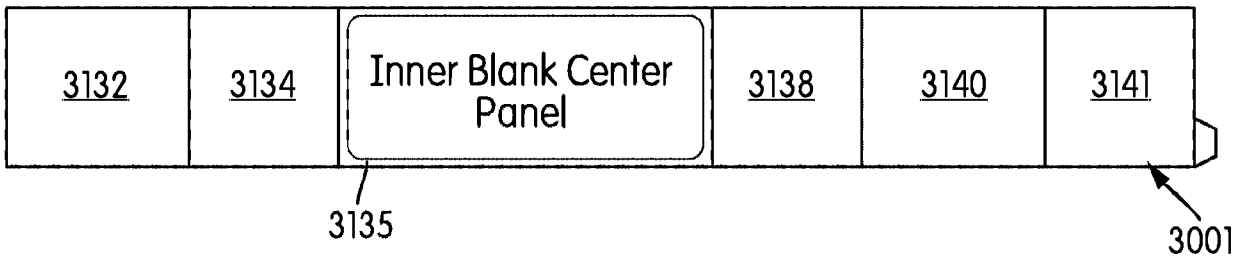
FIG. 12A is a plan view of first blank that forms the inner portion of a box of third exemplary embodiment.
Figure 12B:
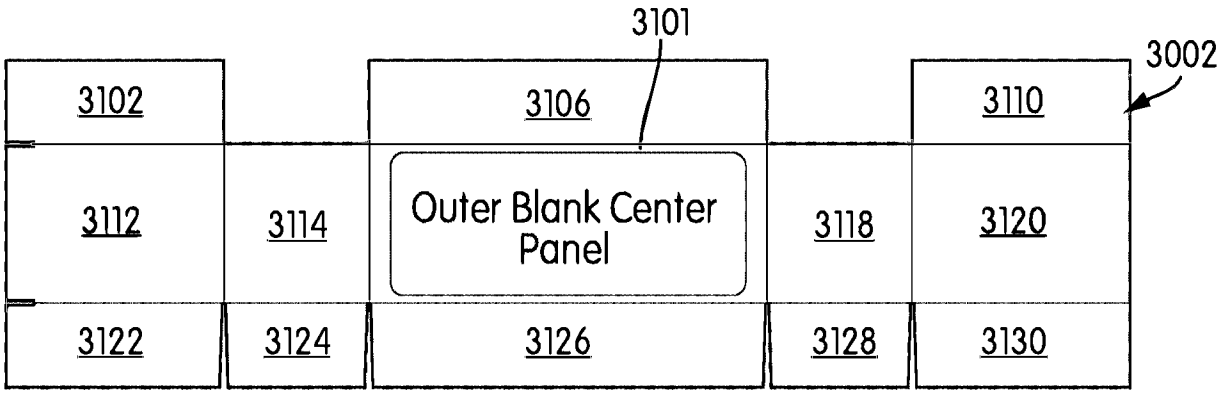
FIG. 12B is a plan view of a second blank that forms the inner portion of the box of the third exemplary embodiment.
Figure 12C:
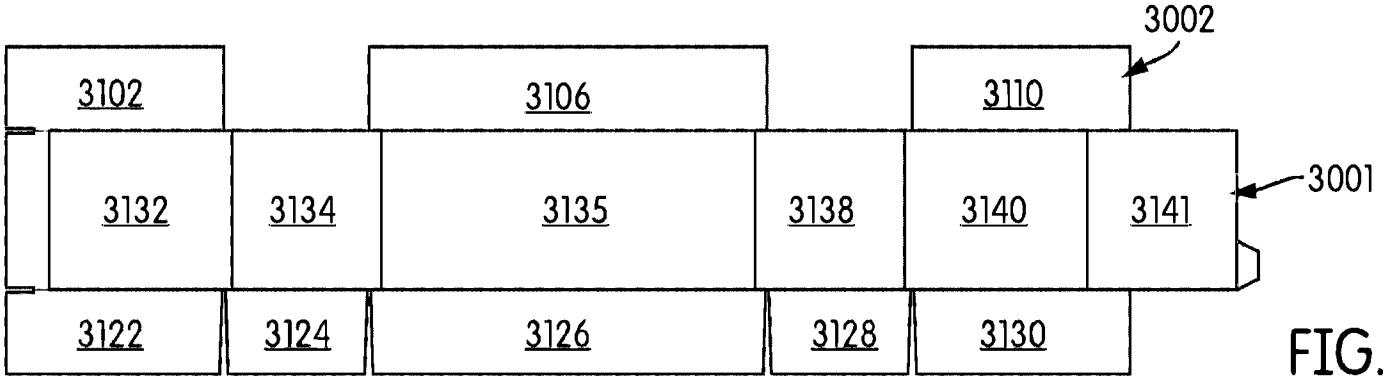
FIG. 12C is a plan view of the first blank of FIG. 12A positioned atop the second blank of FIG. 12B.

A third exemplary embodiment of a container in FIGS. 12A, 12B & 12C. In this example, the box is constructed from two corrugated fiberboard blanks, an inner blank 3001 and an outer blank 3002. The outer blank 3002 has the same panel and flap elements as the outer portion 1190 of blank 1100, with the exception of the pivot arms 1144*a*, 1144*b*. The inner blank 3001 has the same panel elements as the inner portion 1220. As shown in FIG. 12C, instead of being aligned by folding pivot arms that connect the blanks, the inner blank 3001 must be manually aligned by a person or piece of machinery when placed atop and affixed to the outer blank 3002. Although this configuration requires additional machinery precision to properly align the inner and outer blanks 3001, 3002, it allows each of the blanks 3001, 3002 to be less complex that than the unitary blank 1100 of FIG. 1.

Figure 13:
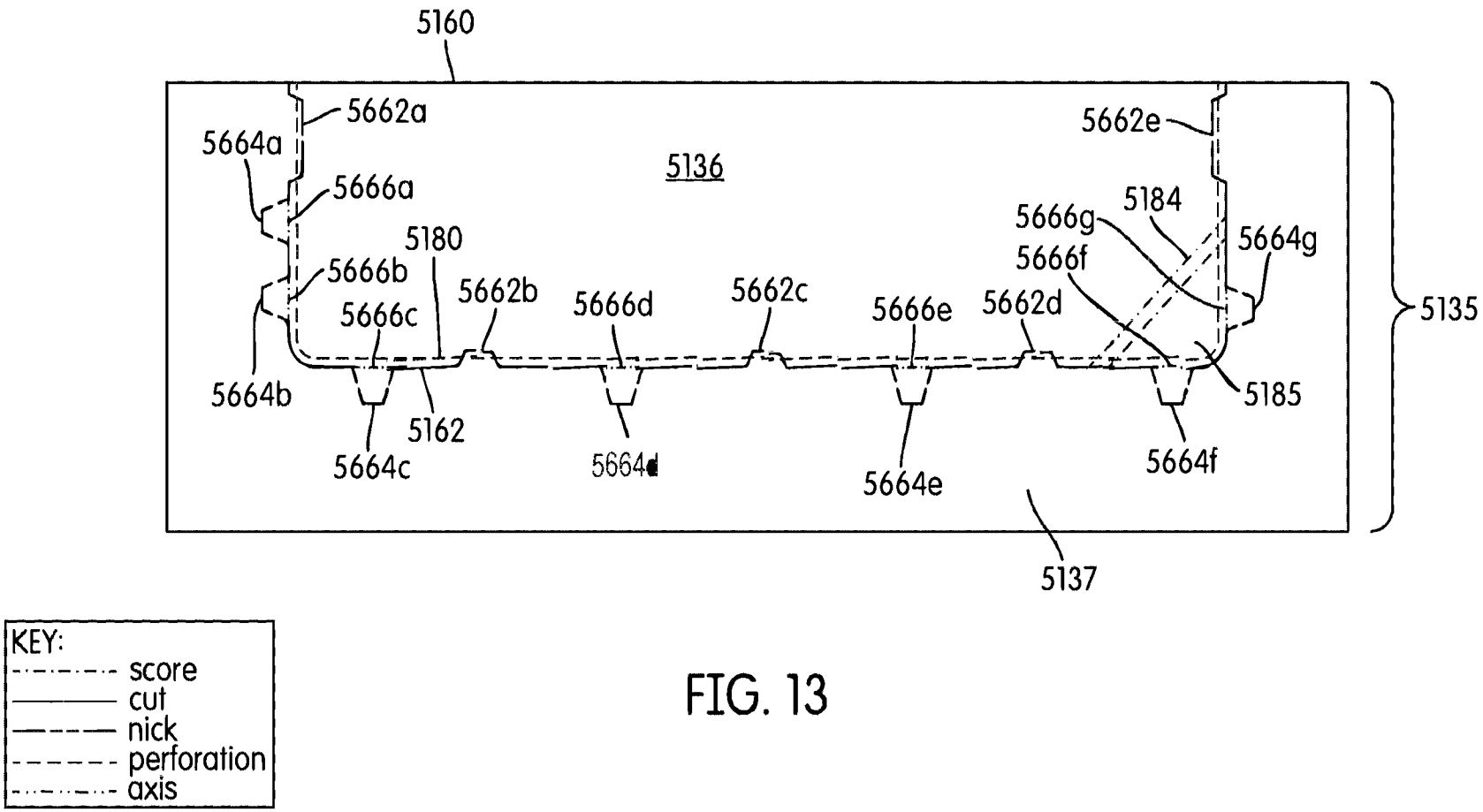
FIG. 13 is an enlarged partial view of the inner front panel of FIG. 2.

FIG. 13 shows another exemplary embodiment of the inner front panel 5135 and outer front panel (positioned behind the inner front panel 5135 in FIG. 13). In this embodiment, the inner separation line 5162 includes projections 5662*a-e*, 5664*a-g* that function as mechanical locks for the removable window. In this embodiment, the inner 15 separation line 5162 would define a substantially a plurality of linear segments with rounded corners connecting the linear segments (resulting in a rectangular perimeter) in the absence of the projections. The raised projections 5662*a-e* are each protrusions in the inner separation line 5162 that are part of the inner fixed portion 5137, extend across the outer separation line 5180 (shown in phantom in FIG. 13), and overlap with the outer removable portion. The recessed projections 5664*a-g* are protrusions that are part of the inner removable portion 5136, extend outwardly across the outer separation line 5180 and overlap with the outer fixed portion.

In the illustrated embodiment, each of the raised projections 5662*a-e* and recessed projections 5664*a-g* are in the shape of an isosceles trapezoid with rounded corners. Other shapes could be used, such as triangular, rectangular, or ovoid polygons, but it is preferable that the shape taper from the base edge to the end edge in order to facilitate removal of the removable window.

In the illustrated embodiment, each of the raised projections 5662*a-e* has parallel base and end edges of non-equal length and two nonparallel left and right edges of equal length. The raised projections 5662*a-e* each has an approximate base edge of ¾-inch (1.9 cm), an approximate end edge width of ½ inch (1.3 cm), an approximate height of ¼ inch (0.64 cm), and interior angles between the base edge and each of the left and right edges of approximately 60-65 degrees. The preferred dimensions of the raised projections 5662*a-e* could range from ⅛ inch (0.32 cm) to ¾ inch (1.9 cm) in height, ½ inch (1.3 cm) to 1¾ inch (3.2 cm) in base edge width, and ¼ (0.64 cm) to 1 inch (2.5 cm) in end edge width. These dimensions are exemplary and not limiting.

In the illustrated embodiment, the substantially trapezoidal recessed projections 5664*a-g* have parallel base and end edges of non-equal length and nonparallel left and right edges of equal length. The recessed projections 5664*a-g* have an approximate base edge width of ¾ inch (1.9 cm), an end edge width of ⅜ inch (0.96 cm), a height of ½ inch (1.3 5 cm), and interior angles between the base edge and each of the left and right edges of approximately 69.4 degrees. The preferred dimensions of the raised projections will range from ⅛ inch (0.32 cm) to ¾ inch (1.9 cm) in height, ½ inch (1.3 cm) to 1¼ inch (3.2 cm) in base edge width, and ¼ (0.64 cm) to 1 inch (2.5 cm) in end edge width. These dimensions are intended to be exemplary and not limiting.

In the illustrated embodiment, projections 5662*a-e*, 5664*a-g* are spaced approximately 3 inches apart (on center) in an alternating configuration (i.e., a raised projection 5662*a-e* followed by a recessed projection 5664*a-g*). In other embodiments, the spacing of the raised and recessed projections 5662*a-e*, 5664*a-g* could be determined by the preferred durability of the container, nature of the contents, and other factors. In addition, only one type of projection (i.e., either raised or recessed) could be provided. In many applications, the projections are preferably between two inches (5.1 cm) and five inches (13 cm) apart (on center).

The raised projections 5662*a-e* of the inner portion 5735 reinforce the removable window of the outer portion (not visible in this figure) by preventing it from collapsing inward during the packaging and shipping processes. The recessed projections 5664*a-g* of the inner portion prevent the window from falling out during shipping.

A scored joint 5666*a-g* is preferably provided along the base edge of each of the recessed projections 5664*a-g*, which coincides with the path that the outer separation line 5180 would follow in the absence of projections. Each of the scored joints 5666*a-g* provides a weakened line along which the recessed projection 5664*a-g* can bend/fold as when the removable window is being removed from the container, allowing each projection 5664*a-g* to pass over the outer fixed portion.

In order to further reinforce the outer window, the inner separation line 5162 and the outer separation line 5180 are preferably offset (preferably by between 1/32 and ¼ inch, more preferably 1/16-¼) when the container is fully assembled. This offset reinforces the outer window panel during packaging and shipping.

Aspects of the window locking and retention features of container 5100 can be configured and customized in a variety of ways, options and arrangements, for providing advantages as desired and as appropriate for particular implementations and anticipated uses of the container 5100. For example, it may be beneficial for smaller implementations that are configured to be stacked in large numbers and that are expected to encounter relatively small stresses during shipping and storage, to configure locking and retention features in way that favors providing quick and easy removal of inner removable portion 5136, versus providing structural reinforcement and enhanced retention features for outer removable window (not shown). Such a customization can reduce the costs and time required to convert a stacked arrangement of the smaller boxes located at a point of sale into a stacked arrangement of display boxes.

In other implementations, aspects and options for locking and retention features can be configured differently to provide enhanced structural integrity features for container 5100, along with providing features for quickly and easily converting the container 5100 into a display. A wide variety of options, aspects, preferences and customizations of features and combinations of features for container 5100 can be selected according to embodiments of the invention, which can provide significant benefits including enhancing the structural integrity for container 5100 when retaining good during shipping and storage, along with providing improved removability of the window.

As shown, in FIG. 13, the inner separation line 5162 preferably includes an intermeshed configuration of alternating inward-oriented, raised projections 5662*a-e* and outward-oriented, recessed projections 5664*a-g*. The intermeshed configuration increases the surface area of frictional contact between the outer front panel and the inner front panel 5135, along with increasing the amount of interfering contact along inner separation line 5162 due to its convoluted, alternating path that forms the intermeshed projections, which increases retention forces for maintaining inner removable portion 5136 within the inner front panel 5135. At the same time, the intermeshed projection configuration provides only minimal or negligible impact on the amount of force and effort a user needs to exert to remove the window when converting the container 5100 into a display, due to pulling the window outward in a rolling motion, which moves the window in a direction that is generally normal to the interface formed along the inner separation line 5162.

Raised projections 5662*a-e* preferably differ from recessed projections 5664*a-g* in ways that further enhance retention of the window within the inner front panel 5135 prior to converting the container 5100 into a display, as well as improving the removability of the window. As can be seen in FIG. 13, recessed projections 5664*a-g* are generally taller, as they extend away from inner separation line 5162 than the raised projections 5662*a-e*. The raised projections 5662*a-e* are generally wider along inner separation line 5162 than the recessed projections 5662*a-g*, both of which help retention of removable window while in a storage configuration and also improve its removability for converting into a display. The taller recess projections 5664*a-g* are connected to the inner removable portion 5136 and, thus, are removed along with inner removable portion 5136 when converting the box into a display. The greater height and shorter width recess projections 5664*a-g* make it easier for them to bend while the window is being removed.

Recessed projections 5664*a-g* are also primarily oriented in a downward direction, and several downward-directed recessed projections 5664 are preferably provided along a bottom portion of inner separation line 5162. Conversely, the recessed projections 5664*a-g* act as generally vertical columns to enhance the transmission of downward forces through inner front panel 5135 of the container 5000 while used as a shipping and storage container.

The raised projections 5662*a-e* also differ from the recessed projections 5664*a-g* in that they are attached to the inner fixed portion 5137 of the inner front panel 5135, extend upwardly into the removable window, and remain attached to the inner fixed portion 5137 even after removal of the window. Further, the raised projections 5662*a-e* abut the removable portion of the outer front panel. Thus, the raised projections 5662*a-e* can act as rearward stops to restrict inward movement of the outer removable portion, and can help prevent the outer removable portion from translating inward when the outer front panel encounters a lateral, inwardly-directed force normal to the front face of the container 5100.

In alternate embodiments, it would be possible to include recessed and/or raised projections on the outer front panel, either in addition to or instead of, the recessed and raised projections shown in the embodiment of FIG. 13. In this embodiment, the projections are provided solely on the inner front panel 5135 to create a cleaner appearance from outside the container 5100.

An inner left corner portion 5185 of the inner removable portion 5136 is shown, which is bordered by a pair of scored joints 5184. In addition, no raised projections 5662*a-e* are located along the portion of the inner separation line 5162 that borders the corner portion 5185. These features combine to enable the corner portion 5185 to be easily pushed in by the fingers of a user and function as a handle to grab and pull the removable window away from the inner fixed portion 5137 in a generally arcuate path.

The presence of the projections 5662*a-e*, 5664*a-g* also enables the inner and outer separation lines 5162, 5180 to be formed with less connected area than would be required to keep the inner removable portion 5136 intact during shipping. In this embodiment, the inner separation line 5162 preferably consists entirely of cuts and nicks. Preferably at least one nick is provided on each projection 5662*a-e*, 5664*a-g* and along the inner separation line between each projection 5662*a-e*, 5664*a-g*. More preferably, at least two nicks are provided on each recessed projection 5664*a-g*. Alternatively, if additional durability is needed, up to 25% of each section of the inner separation line 5162 between each projection 5662*a-e*, 5664*a-g* could be perforated. In this embodiment, the outer separation line 5180 also consists entirely of nicks and cuts, with at least two nicks being preferably present on each linear segment.

Figure 14:
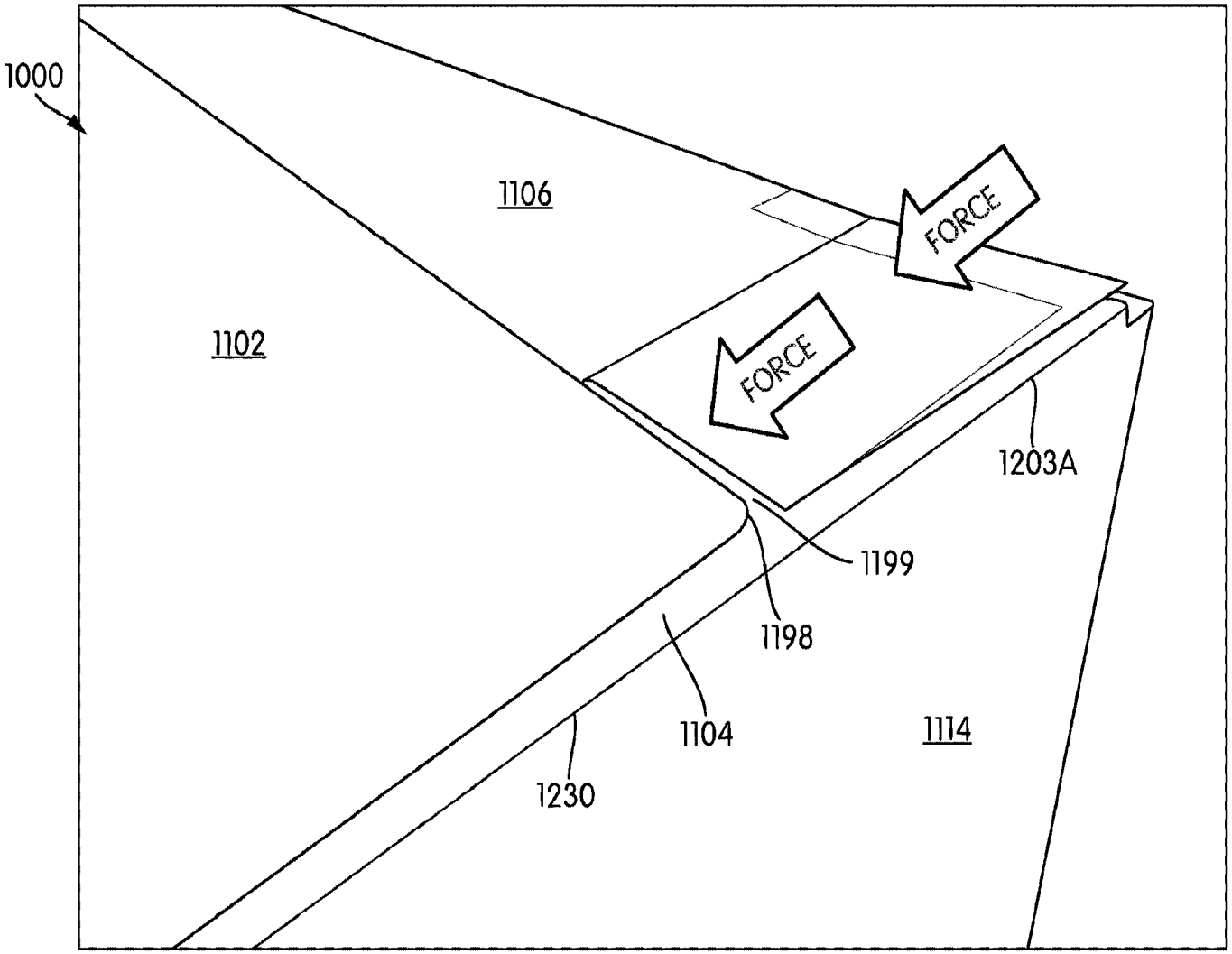
FIG. 14 is an enlarged partial view of the top right corner of the fully assembled box if FIG. 9, shown with the top back major flap taped down.

As shown in FIGS. 1 and 14, generally rectangular cut-away portions 1109*a* and 1109*b* are formed at what would typically be the rear, corner portions of top front major flap 1106. Cut-away portions 1109*a* and 1109*b* are disposed at opposite ends of the top front major flap 1106 and include a stop edge 1199 that is generally parallel with the front of the outer removable portion 1116 and the forward lateral edge 1198 of left top back major flap 1102. As such, when container 1000 is fully closed and top major flaps 1102 and 1106 are secured down along the top of container 1000, stop edge 1199 is aligned with and disposed proximate to and opposing forward lateral edge 1198 at each side of container 1000. This enables any lateral forces or frontal impacts applied to upper portions of the outer removable portion 1116 and/or to outer front panel 1101 of container 1000 to be transmitted through top front major flap 1106 until it reaches stop edge 1199, which impacts against forward lateral edge 1198 if the top portion of outer removable portion 1116 is translated rearward.

The interface between stop edge 1199 and forward lateral edge 1198 during contact that occurs due to rearward forces being transmitted through top front major flap 1106 will produce interfering contact with between edges 1199 and 1198. The interfering contact acts as a stop that can prevent deformation of the top portion of container 1000 and avoid premature separation of removable window from the box. Such a stop feature can significantly reinforce and strengthen the box and its removable window 1116 while having little or no effect on the removability of the window. Preferably, these stop features are combined with other reinforcement and strengthening features discussed above and associated with the inner front panel 1135 of the blank 1100 to provide a container 1000 that also has the ability to be quickly and easily be converted into a display.

It will be appreciated that the invention is not restricted to the details described above with reference to the preferred embodiments but that numerous modifications and variations can be made without departing from the spirit or scope of the invention as defined in the following claims.

What is claimed is:

1. A container comprising:

an outer portion comprising an outer front panel having an outer fixed portion an outer removable portion, an outer left side panel extending from a left edge of the outer front panel, an outer right side panel extending from a right edge of the outer front panel, and at least one outer back panel, the outer front panel, the outer left side panel, the outer right side panel, and the at least one outer back panel forming an enclosed perimeter wall;

an inner portion comprising an inner front panel having an inner fixed portion and an inner removable portion, an inner left side panel, an inner right side panel, an inner left back panel, an inner right back panel, the inner front panel being affixed to the outer front panel, the inner back left back panel and the inner right back panel being affixed to the at least one outer back panel, the inner left side panel extending from the inner front panel to the inner left back panel in spaced apart relation to the outer left side panel, the inner right side panel extending from the inner front panel to the inner right back panel in spaced apart relation to the outer right side panel;

a top front major flap extending from one of the outer front panel and the inner front panel, a top left minor flap extending from the outer left side panel, a top right minor flap extending from the outer right side panel, and at least one top back major flap, each of the at least one top back major flap extending from one of at least one outer back panel, the top front major flap, a top left minor flap, the top right minor flap, and the at least one top back major flap being shaped and positioned to form a substantially enclosed top surface;

a bottom front major flap extending from one of the outer front panel and the inner front panel, a bottom left minor flap extending from the outer left side panel, a bottom right minor flap extending from the outer right side panel, and at least one bottom back major flap, each of the at least one bottom back major flap extending from one of at least one outer back panel, the bottom front major flap, a bottom left minor flap, the bottom right minor flap, and the at least one bottom back major flap being shaped and positioned to form a substantially enclosed bottom surface;

a removable window comprising the outer removable portion and the inner removable portion; and an inner separation line that defines a border between the inner fixed portion and the inner removable portion and an outer separation line that defines a border between the outer fixed portion and the outer removable portion.

2. The container of claim 1, wherein the removable window further comprises the top front major flap.

3. The container of claim 1, wherein the outer portion and the inner portion are formed from a single unitary blank.

4. The container of claim 1, wherein the outer portion is formed from a first blank and the inner portion is formed from a second blank.

5. The container of claim 1, wherein the outer portion has an outer thickness, the inner portion has an inner upper edge and the outer portion has an outer upper edge, wherein the inner portion is attached to the outer portion so that that inner upper edge is positioned below the outer upper edge by a first distance, the first distance being no less than the outer thickness.

6. The container of claim 5, wherein the first distance is no less than the outer thickness and no greater than three times the outer thickness.

7. The container of claim 1, wherein when the removable window is attached to the container, the outer separation line is offset from the inner separation line.

8. The container of claim 7, wherein the outer separation line is offset from the inner separation line by at least 4 mm.

9. The container of claim 1, wherein the at least one outer back panel comprises a left outer back panel and a right outer back panel, the left outer back panel having an overlapping back panel portion that overlaps and is adhered to the right outer back panel.

10. The container of claim 9, wherein the at least one top back major flap comprises a left top back major flap and a right top back major flap, the left top back major flap having an overlapping top flap portion that overlaps with and is adhered to the right top back major flap.

11. The container of claim 9, wherein the at least one bottom back major flap comprises a left bottom back major flap and a right bottom back major flap, the left bottom back major flap having an overlapping bottom flap portion that overlaps with and is adhered to the right bottom back major flap.

12. A container comprising:

an outer front panel having an outer fixed portion and an outer removable portion, an inner front panel having an inner fixed portion and an inner removable portion, an outer left side panel located adjacent to a left edge of the outer front panel, an outer right side panel located adjacent a right edge of the outer front panel, and at least one outer back panel, the outer front panel, the outer left side panel, the outer right side panel, and the at least one outer back panel forming an enclosed perimeter wall, the inner front panel being affixed to the outer front panel;

a top front major flap extending from one of the outer front panel and the inner front panel, a top left minor flap extending from the outer left side panel, a top right minor flap extending from the outer right side panel, and at least one top back major flap, each of the at least one top back major flap extending from one of at least one outer back panel, the top front major flap, a top left minor flap, the top right minor flap, and the at least one top back major flap being shaped and positioned to form a substantially enclosed top surface;

a floor that forms a substantially enclosed bottom surface;

a removable window comprising the inner removable portion and the outer removable portion; and a plurality of projections, each of the plurality of projections being part of one of an inner separation line and an outer separation line;

wherein when the removable window is separated from the container, the removable window is adapted to separate from the outer fixed portion along the outer separation line and to separate from the inner fixed portion along the inner separation line; and wherein when the removable window is attached to the container, any of the plurality of projections that is part of the outer fixed portion overlap with the inner removable portion, any of the plurality of projections that is part of the outer removable portion overlaps with the inner fixed portion, any of the plurality of projections that is part of the inner fixed portion overlap with the outer removable portion, any of the plurality of projections that is part of the inner removable portion overlaps with the outer fixed portion.

13. The container of claim 12, wherein each of the plurality of projections has an end edge located at least ⅛ inches from a base edge when the removable window is attached to the container.

14. The container of claim 12, wherein each of the plurality of projections includes at least one connection point.

15. The container of claim 14, wherein the at least one connection point of each of the plurality of projections consists of no more than two nicks.

16. The container of claim 12, wherein the inner separation line consists of cut portions and nicks.

17. The container of claim 16, wherein the outer separation line consists of cut portions and nicks.

18. The container of claim 12, wherein the removable window further comprises the top front major flap.

19. The container of claim 12, wherein the removable window includes at least one scored joint, the at least one scored joint and the outer separation line defines a removal handle located in a lower corner of the removable window.

20. The container of claim 12, wherein the front major flap includes a first cut-away located at an upper left edge of the front major flap and a second cut away located at an upper right edge of the front major flap, the front major flap including a middle portion located between the first cut-away and second cut-away, wherein the first cut-away is sized and located to enable a first portion of an upper edge of the top back major flap to abut the top front major flap and the first portion of the top back major flap to rest against the top left minor flap while the middle portion is positioned beneath the top back major flap and the second cut-away is sized and located to enable a second portion of an upper edge of the top back major flap to abut the top front major flap and the second portion of the top back major flap to rest against the top left minor flap while the middle portion is positioned beneath the top back major flap.

21. The container of claim 12, wherein the container has a width and the top back major flap has a width and the width of the top back major flap is more than half of the width of the container.

22. The container of claim 21, further comprising a top tape strip having a width, the top tape strip being adhered across the entire width of the top tape strip to the outer left side panel, the outer right side panel, and the top back major flap.

23. The container of claim 12, further comprising an inner left side panel, an inner right side panel, an inner left back panel, an inner right back panel, the inner back left back panel and the inner right back panel being affixed to the at least one outer back panel, the inner left side panel extending from the inner front panel to the inner left back panel in spaced apart relation to the outer left side panel, the inner right side panel extending from the inner front panel to the inner right back panel in spaced apart relation to the outer right side panel.

24. The container of claim 12, wherein the floor comprises a bottom front major flap extending from one of the outer front panel and the inner front panel, a bottom left minor flap extending from the outer left side panel, a bottom right minor flap extending from the outer right side panel, and at least one bottom back major flap, each of the at least one bottom back major flap extending from one of at least one outer back panel.

* * * * *